United States Patent [19]

Gimbel

[11] 4,270,287

[45] Jun. 2, 1981

[54] FRAMED PICTURE HOLDER

[76] Inventor: R. Keith Gimbel, 456 Parlin St., Philadelphia, Pa. 19116

[21] Appl. No.: 971

[22] Filed: Jan. 4, 1979

[51] Int. Cl.[3] ..... G09F 01/12

[52] U.S. Cl. ..... 40/152; 40/10 R; 40/156; 40/209

[58] Field of Search ..... 40/152, 152.1, 154, 40/155, 156, 158 R, 159, 10 R, 10 D, 209

[56] References Cited

U.S. PATENT DOCUMENTS

| | | | |
|---|---|---|---|
| 1,575,949 | 3/1926 | Thorn | 40/16.4 |
| 1,664,302 | 3/1927 | Leopold et al. | 40/205 |
| 1,758,627 | 5/1930 | Sweitzer | 40/209 |
| 1,879,906 | 9/1932 | Linstrom | 40/209 |
| 2,140,067 | 12/1938 | Batcheller | 40/209 X |
| 2,211,923 | 8/1940 | Dittmar | 40/209 |
| 2,501,474 | 3/1950 | Martin | 40/10 R X |
| 2,741,046 | 7/1953 | Kroslak | 40/209 |
| 2,827,722 | 5/1957 | Leclerc | 40/209 |
| 2,853,818 | 9/1958 | Simon et al. | 40/209 |
| 3,182,413 | 5/1965 | Karoly | 40/10 R |
| 3,369,451 | 2/1968 | Brandt et al. | 40/155 |
| 3,374,568 | 3/1968 | Trammell | 40/209 |
| 3,755,945 | 9/1973 | McEwen et al. | 40/209 |

*Primary Examiner*—Gene Mancene
*Assistant Examiner*—G. Lee Skillington
*Attorney, Agent, or Firm*—Weiser, Stapler & Spivak

[57] ABSTRACT

A framed picture holder suitable for affixing to a supporting member which includes a relatively stiff, clear front cover, a relatively flexible, clear or opaque rear cover and a sectional frame of suitable dimensions to peripherally join the front and rear covers. An indicia bearing sheet, which may be a photograph, is cut to the size and configuration of the front cover and the rear cover and is sandwiched therebetween. The peripheral framing members secure the parts together. A plurality of registered openings are provided through the combination front cover, picture and rear cover for attaching purposes.

9 Claims, 4 Drawing Figures

FRAMED PICTURE HOLDER

BACKGROUND OF THE INVENTION

The invention relates generally to the field of protective frames, and more particularly, is directed to a novel frame suitable for attachment to automobiles and the like.

It is known to provide frames or holders suitable for attachment to automobiles to hold therein relatively rigid articles, such as an automobile license plate. For example, U.S. Pat. Nos. 2,211,923, 2,741,046, 3,182,413, 3,755,945, 1,664,302 and 2,827,722 all show various types of holders or frames suitable for use in attaching a vehicle license plate to the vehicle. While, so far as it is known, all of the designs of the prior patents can function to secure a license plate to an automobile or other vehicle, these prior art types of holders are not designed to hold a flexible, planar article such as a picture nor are the frames particularly designed to be easily disassembled and assembled without using special tools when securing the license or other article to be stored therewithin prior to affixing the assembly to a part of the vehicle.

SUMMARY OF THE INVENTION

The present invention relates generally to the field of framed holders, and more particularly, is directed to a framed holder suitable to encompass a picture to affix the framed picture to a permanent backing, for example a portion of an automobile.

The framed cover of the present invention includes generally a relatively stiff, clear front cover which may be fabricated of clear plastic, such as "Plexiglas" or "Lexan" or which may be fabricated of glass. Preferably the front cover is configured to a rectangular shape of size and configuration of a usual automobile license plate. A rear cover of the same size and shape as the front cover is provided of a clear or opaque material to provide rear protection for a photograph or other indicia bearing sheet which is sandwiched between the front and rear covers.

A frame, which preferably is in a form of four discrete sections, each of which has mitered ends, peripherally surrounds the front and rear covers. The photograph or other indicia bearing sheet is sandwiched between the front and rear covers and is trimmed to the same size and configuration. By applying and securing the framed sections to the periphery of the sandwich comprising the front cover, the rear cover and the photograph therebetween, a permanently framed holder can be developed in a simple and inexpensive manner.

In the preferred embodiment, a plurality of upper and lower openings are provided through the combination of the front cover, the picture and the rear cover to facilitate attaching the framed picture holder to a suitable substrate, for example a portion of an automobile. Resilient grommets, which may be rubber, are provided through the aligned openings in known manner to provide a finished package suitable for attachment that is substantially moisture free.

It is therefore an object of the present invention to provide an improved framed picture holder of the type set forth.

It is another object of the present invention to provide a novel framed picture holder comprising a relatively inflexible front cover, a relatively flexible rear cover and an indicia bearing sheet sandwiched therebetween.

It is another object of the present invention to provide a novel framed picture holder including front and rear clear plastic holders, a picture sandwiched therebetween and a sectional, peripheral frame securing the parts together for permanent installation upon a vehicle or other body.

It is another object of the present invention to provide a novel framed picture holder including a front clear plastic sheet, a rear plastic sheet, an indicia bearing sheet therebetween, a peripheral frame securing the sandwiched covers and sheet together and moisture resistant attaching means formed through the front and rear covers and the intermediate sheet to facilitate a weather tight installation.

It is another object of the present invention to provide a novel framed picture holder that is inexpensive in manufacture, simple in design and trouble free when in use.

Other objects and a fuller understanding of the invention will be had by referring to the following description and claims of preferred embodiments thereof, taken in conjunction with the accompanying drawing wherein like reference characters refer to similar parts through the several views and in which:

DESCRIPTION OF THE PREFERRED EMBODIMENTS OF THE INVENTION

Figure 1:
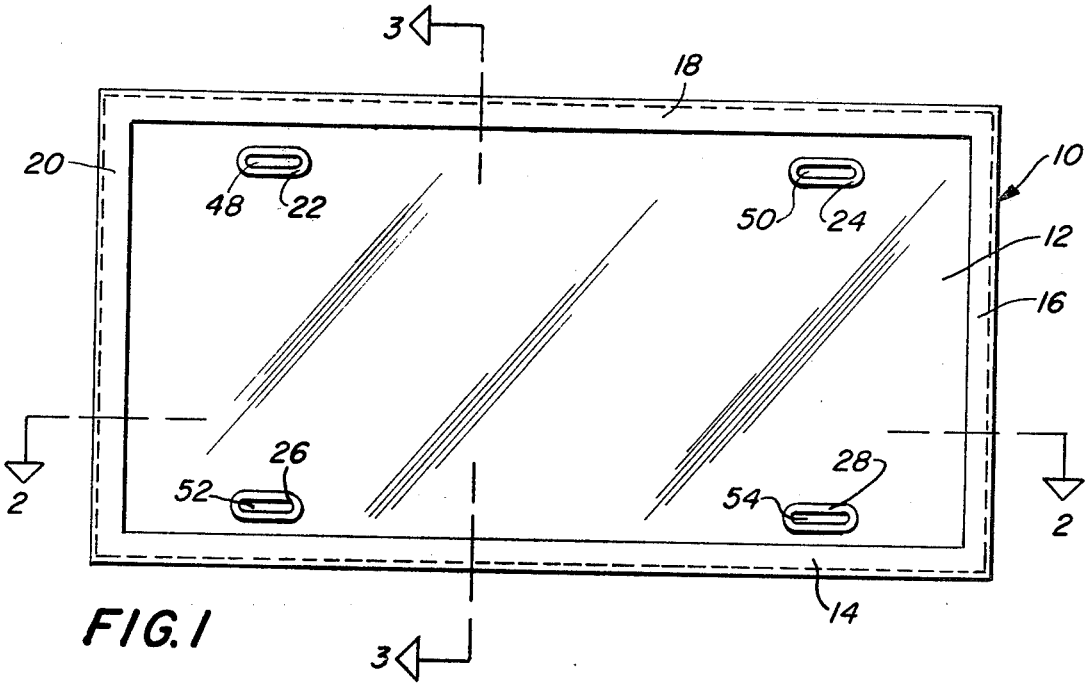
FIG. 1 is a front elevational view of a framed picture holder constructed in accordance with the present invention.

Although specific terms are used in the following description for the sake of clarity, these terms are intended to refer only to the particular structure of the invention selected for illustration in the drawings and are not intended to define or limit the scope of the invention.

Figure 2:
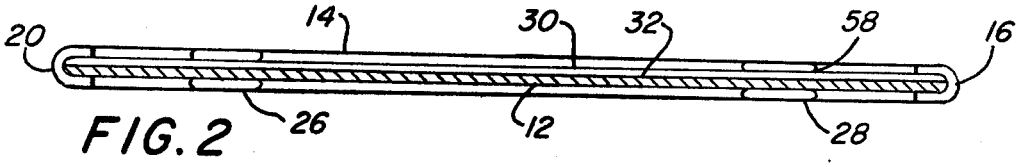
FIG. 2 is a cross-sectional view taken along line 2—2 on FIG. 1 looking in the direction of the arrows.

Referring now to the drawings, there is shown in FIGS. 1 and 2, a framed picture holder generally designated 10 which comprises a front or first clear cover 12, a second or rear cover 30 and a peripheral, sectional frame, comprising a bottom frame member 14, a side member 16, a top frame member 18 and a side frame member 20.

Preferably, the front cover 12 is fabricated of a relatively stiff, inflexible, clear, plastic material such as "Plexiglas," "Lexan" or other suitable clear material which permits a picture 32 or other indicia bearing sheet to be viewed therethrough. In a preferred embodiment, 0.10 inch thickness, cellulose acetate butyrate plastic sheet, with suitable mounting openings 48, 50, 52, 54 provided therethrough was employed for this purpose. The framed picture holder 10 further comprises a registered rear cover 30 which may be fabricated of clear plastic such as acetate, or polyethylene sheet plastic of the same configuration and dimensions as the front cover 12. In a preferred embodiment, 20 mil thickness cellulose acetate butyrate plastic sheet was employed. Suitable openings, in registry with the mounting openings 48, 50, 52, 54 were provided for mounting the holder 10 as herein after more fully set forth. The framed picture holder 10 further comprises a registered rear cover 30 which may be fabricated of clear plastic such as acetate, or polyethylene sheet plastic of the same configuration and dimensions as the front cover 12. Both the front cover 12 and the rear cover 30 should be impervious to moisture to thereby prevent the entrance of rain water or other moisture into the interior area of the framed picture holder 10 when the parts are suitably assembled. It is the purpose of this invention to provide a separate front cover 12 and a rear cover 30 whereby an indicia bearing sheet, such as a photograph or picture 32 can be easily sandwiched therebetween for display purposes.

It is contemplated that a picture or photograph 32, such as a photograph of the owner's automobile, boat, house or other item of interest will be enlarged as necessary and then trimmed to the same size and configuration as the front clear cover 12 and the rear cover 30 and then sandwiched therebetween in registry therewith. With the front cover 12, the picture 32 and the rear cover 30 in registry, generally U-shaped plastic or metal separate frame members 14, 16, 18, 20 can be applied at the periphery of the registered materials. Upon the application of inwardly directed forces, the frame members 14, 16, 18, 20 can be urged inwardly to sandwich and secure the front and rear covers 12, 30 about the indicia bearing sheet or picture 32. As best seen in FIG. 1, the frame members 14, 16, 18, 20 are preferably mitered at the corners to provide a tight junction therebetween, to facilitate moisture resistance and to provide a finished appearance to the completely assembled framed picture holder 10. In the preferred embodiment, the picture frame members 14, 16, 18, 20 are fabricated of decorative flexible plastic molding with permanent chrome finish similar to that manufactured by Silvatrim Corporation of America, South Plainfield, N.J. and marketed under the trademark "Silvatrim."

In the preferred embodiment, the frame members 14, 16, 18, 20 within the area defined by the U-shape are provided with a first means for sealing such as a weatherproof, water resistant pressure-sensitive adhesive 56 of suitable type to bond firmly to the peripheral edges of the front and rear covers 12, 30 and of the picture 32. One suitable pressure-sensitive adhesive is supplied by Silvatrim Corporation of America, South Plainfield, N.J. under the mark "Evergrip." By supplying such a pressure-sensitive, water-proof adhesive 56, the peripheral edges of the sandwiched front and rear covers and the interior picture will be bonded and secured against the entrance of moisture to provide a permanent, moisture proof installation.

Figure 3:
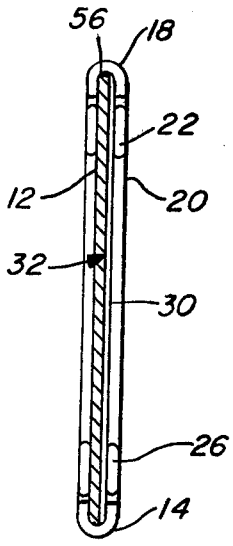
FIG. 3 is a cross-sectional view taken along line 3—3 on FIG. 1 looking in the direction of the arrows.
Figure 4:
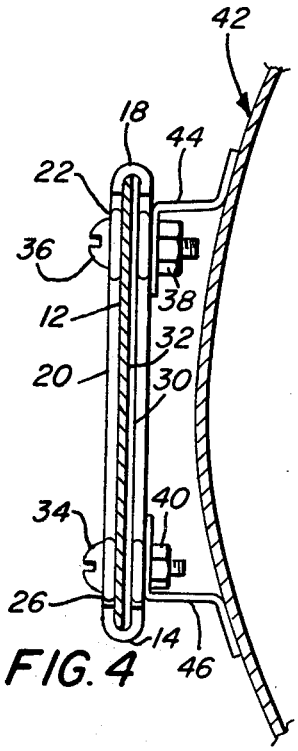
FIG. 4 is a side elevational view of the framed picture holder of FIG. 1 installed upon the front bumper of an automobile.

As best seen in FIGS. 1, 2 and 3, the sandwiched front cover 12, rear cover 30 and picture 32 are provided with a plurality of mounting openings to facilitate installation through a permanent backup member or substrate, such as an automobile bumper 42 (FIG. 4). The plurality of openings are completely lined with resilient grommets 22, 24, 26, 28 of weatherproof construction, such as rubber. The grommets 22, 24, 26, 28 preferably are sized to be a press fit within their respective mounting openings and may be cemented in place by utilizing a suitable weatherproof adhesive 58 which forms a second means for sealing or other construction to provide a watertight or water resistant junction between the respective grommets and the front and rear covers 12, 30. In this manner, suitable mounting openings are provided and at the same time, the unwanted entrance of rain water or other moisture is discouraged.

As best illustrated in FIG. 4, the framed picture holder 10 may be mounted upon a substrate, such as an automobile bumper 42 by applying upper and lower brackets 44, 46 having openings therethrough in registry with the openings defined within the grommets 22, 24, 26, 28. A plurality of nut and bolt combinations 36, 38 and 34, 40 can be employed in conventional manner through the openings defined within two or more of the grommets 22, 24, 26, 28 to secure the framed picture holder 10 to the brackets 44, 46 in suitable, well-known manner.

In order to use the framed picture holder of the present invention, a desired indicia bearing sheet 32, which can be a picture of any suitable object is enlarged as necessary and then trimmed to the configuration of the front cover 12 and the rear cover 30 in usual manner, such as by employing a pair of scissors (not shown). After the picture 32 has been suitably cut to shape, it is sandwiched between the front cover 12 and the rear cover 30 in registry therewith. The frame sections or members 14, 16, 18, 20 are respectively applied at the periphery of the sandwiched materials 12, 32 and 30 and by applying inwardly directly pressures, the mitered edges are pressed together and the pressure-sensitive adhesive 56 is peripherally applied to the sandwiched materials to provide a moisture proof, permanent bond therewith. Mounting openings may be provided through the front cover 12, the picture 32 and the rear cover 30 either before or after assembly in a manner to assure registry of the openings through the sandwiched materials upon assembly. The grommets 22, 24, 26, 28 are then applied in known manner to align the mounting openings in a substantially waterproof manner to prevent the entrance of rain water or other moisture therebetween. A suitable moisture resistant adhesive 58 may be employed at the junction between the resilient grommets 32–28 and the mounting openings to facilitate the moisture resistance of the construction. After assembly of the parts in the manner described, the framed picture holder 10 with any desired indicia bearing sheet 32 mounted therewithin can be readily mounted to usual mounting brackets 44, 46 or other suitable mounting construction by employing a plurality of known mounting members such as nut and bolt combinations 36, 38 or 34, 40 or other known fastening means.

After the photograph 32 is trimmed as necessary to conform to the configuration of the front and rear covers 12, 30 a suitable adhesive may be applied to the front and rear faces of the photograph to secure the photograph in place. One suitable adhesive for this purpose is the clear spray adhesive manufactured by Minnesota Mining and Manufacturing Company, St. Paul, Minn. and sold under the trademark "Photo Mount."

In accordance with the foregoing, the separate structural parts of the present invention all cooperate and interact to provide an easily assembled, readily mounted, weatherproof, framed picture holder suitable to display an indicia bearing sheet of any desired representation.

Although the present invention has been described with reference to particular embodiments herein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

What is claimed is:

1. In a picture holder, the combination of a first cover of water-resistant, relatively stiff, clear material, the first cover being provided with a first mounting opening therethrough;

a second cover of water-resistant material in registry with the first cover, the first and second covers being of the same size and configuration, the second cover being provided with a second mounting opening, the second mounting opening being in registry with the first mounting opening;

peripheral frame peripherally joining the first and second covers;

first means for sealing the peripheral junction of the first and second covers, said first means for sealing is within the peripheral frame and is water resistant; and second means for sealing the periphery of the registered first and second mounting openings to prevent the entrance of moisture into the area defined between the first and second covers, said second means for sealing is water resistant, the second means for sealing comprising a hollow, resilient, water resistant grommet, the grommet lining the periphery of the first and second mounting openings, the hollow portion of the grommet defining a mounting opening therethrough.

2. The picture holder of claim 1 and a flexible, indicia bearing sheet sandwiched between the first and second covers, the indicia bearing sheet being of the same size and configuration as the first and second covers, the frame peripherally sealing the periphery of the said sheet.

3. The picture holder of claim 2 wherein the indicia bearing sheet is a photograph.

4. The picture holder of claim 2 and a mounting bolt positioned through the first and second mounting openings, through the indicia bearing sheet and through the hollow portion of the grommet to mount the holder upon a substrate.

5. The picture holder of claim 4 wherein the first cover has a planar front face and a portion of the grommet extends forwardly of the front face to isolate the front face from the mounting bolt and to prevent the mounting bolt from contacting the front face.

6. The picture holder of claim 4 or 5 wherein the second cover has a planar rear face and a portion of the grommet extends rearwardly of the rear face to isolate the rear face from the mounting bolt and to prevent the mounting bolt from contacting the rear face.

7. The picture holder of claim 1 wherein the peripheral frame comprises a plurality of separate, discrete frame sections and wherein each frame section is generally U-shaped in cross-sectional configuration having spaced legs forming the U-shape and being adapted to slide over and to secure peripherally the registered first and second covers.

8. The picture holder of claim 7 wherein a decorative metallic foil is adhered to a surface of the frame sections to provide a decorative, metallic finish.

9. The picture holder of claim 1 wherein the first means for sealing comprises a water resistant adhesive, the said water resistant adhesive being positioned within the interior space defined by the legs of the U-shaped frame members and contacting the peripheral edges of the first and second covers.

* * * * *